US005210578A

United States Patent [19]

Saito et al.

[11] Patent Number: 5,210,578

[45] Date of Patent: May 11, 1993

[54] FEEDING DEVICE

[75] Inventors: Yoshimi Saito; Kiyoshi Negishi, both of Saitama, Japan

[73] Assignee: Asahi Kogaku Kogyo Kabushiki Kaisha, Tokyo, Japan

[21] Appl. No.: 901,165

[22] Filed: Jun. 19, 1992

[30] Foreign Application Priority Data

Jun. 19, 1991 [JP] Japan ..... 3-245297
Jul. 9, 1991 [JP] Japan ..... 3-264253

[51] Int. Cl.[5] ..... G03G 15/20

[52] U.S. Cl. ..... 355/285; 355/208; 355/309

[58] Field of Search ..... 355/308, 309, 316, 203, 355/204, 208, 209, 282, 285, 295, 290; 271/202, 270, 272, 273, 274

[56] References Cited

U.S. PATENT DOCUMENTS

| | | | |
|---|---|---|---|
| Re. 33,770 | 12/1991 | Torino et al. | 355/290 |
| 4,870,434 | 9/1989 | Negishi et al. | 346/160 |
| 4,912,490 | 3/1990 | Negoro et al. | 346/160 |
| 4,928,141 | 5/1990 | Poehlein et al. | 355/208 |
| 4,941,021 | 7/1990 | Uchida et al. | 355/285 |
| 4,949,104 | 8/1990 | Negoro et al. | 346/153.1 |
| 5,045,892 | 9/1991 | Morisawa et al. | 355/309 |
| 5,049,944 | 9/1991 | DeBolt et al. | 355/284 |
| 5,053,829 | 10/1991 | Field et al. | 355/290 |
| 5,070,231 | 12/1991 | Bacus et al. | 219/216 |

FOREIGN PATENT DOCUMENTS 2201432 9/1988 United Kingdom .

OTHER PUBLICATIONS

British Search Report.

*Primary Examiner*—A. T. Grimley
*Assistant Examiner*—Sandra L. Brase
*Attorney, Agent, or Firm*—Sandler Greenblum & Bernstein

[57] ABSTRACT

In an electrophotographic imaging apparatus using a continuous form recording sheet, provided are a heat roller which is driven to rotate, and a back up roller driven by the heat roller to rotate, and a motor for driving the heat roller to rotate. In the imaging apparatus, the variation of the feeding speed of the recording sheet due to deformation thereof is detected, and the rotational speed of the motor is controlled so as to feed the recording sheet at a predetermined feeding speed.

7 Claims, 13 Drawing Sheets

FEEDING DEVICE

BACKGROUND OF THE INVENTION

The present invention relates to a feeding device for an imaging apparatus which carries out a printing operation on a continuous form recording sheet.

Conventionally, as an electrophotographic imaging apparatus, there have been known an electronic copy machine, a laser beam printer, and the like. In such an electrophotographic imaging apparatus, a uniformly charged surface of a photoconductive is exposed to light by an exposing unit in order to form a latent image on the basis of image information. Then, toner is stuck to the latent image by a developing unit so as to form toner image. And, in turn, the developed toner image is transferred onto a recording sheet by a transferring unit. Subsequently, the transferred toner image is finally fixed by a fixing unit.

In the above-described fixing unit, there has been generally employed a so-called heat-roll fixing device, which includes a pair of fixing rollers. The pair of fixing rollers comprises a heat roller to be heated to a predetermined high temperature zone, and a back up roller being abutted against the heat roller with a predetermined pressure.

A recording sheet bearing an unfixed toner image is inserted between the pair of fixing rollers, so that heat and pressure are applied to the recording sheet. By applying heat and pressure, the toner images are fused and fixed on the recording sheet. Thus, the fixing operation is accomplished.

In general, when the feeding operation of a recording sheet is carried out in the printer, an error of the feeding speed of the recording sheet tends to occur due to, for example, tolerance of the feeding roller's radius and expansion/contraction occurring during the feeding operation.

Especially, when the pair of fixing rollers are constituted to serve, not only as fixing rollers, but as recording sheet feeding rollers, there was a problem such that an error of the feeding speed of the recording sheet tends to occur due to the increase/decrease of the radius of the fixing rollers caused by temperature change, or abrasion or recording sheet expansion/contraction caused by temperature change.

FIG. 13 shows an example of a pair of fixing rollers 8 capable of functioning as a recording sheet feeding roller. In the drawing, a heat roller 81 is driven by a drive source 40 to rotate at a predetermined rotational speed. A back up roller 82 is rotatably abutted against the heat roller 81 with a predetermined pressure.

The heat roller 81 has a circumferential surface coated with fluorocarbon resin or applied with silicon oil in order to prevent seizure of toner or offset phenomenon. Accordingly, the circumferential surface of the heat roller 81 has an extremely low frictional coefficient.

When the feeding operation of the recording sheet is practically carried out with use of the pair of fixing rollers 8, the backup roller 82 is driven to rotate by the heat roller 81. Thus, a recording sheet is fed by the paired fixing rollers 8.

When the recording sheet 20 is fed as shown in FIG. 13, the back up roller 82 has different temperatures between a region 82B which contacts the recording sheet 20 and regions 82A which directly contact the heat roller 81.

That is, the region 82A of the backup roller 82 has a higher temperature than the region 82B does because region 82A receives heat directly from the heat roller 81. Therefore, the diameter of the region 82A of the backup roller 82 becomes larger than that of the region 82B due to difference of the amount of expansion. In other words, even if the surface speed of the cylindrical region 82A equals that of the heat roller 81, the surface speed of the cylindrical region 82B becomes slower than that of the heat roller 81, since the diameter of the region 82B is smaller than that of the region 82A.

As a result, a feeding speed of the recording sheet 20 becomes relatively slower since it is fed in accordance with the small diameter region 82B. This phenomenon is remarkably recognized in the case where the recording sheet has a narrow width.

Furthermore, in the electrophotographic printer, it is necessary to synchronize the feeding operation of recording sheet with the exposure operation. Therefore, if the feeding speed of the recording sheet varies as described above, it is feared that the image formation would not be executed in a normal conditions.

On the other hand, if the sheet feed operation is once interrupted and restarted after a certain period of time, the following problems may be caused.

During above certain period, the temperature of the backup roller 82 may be lowered. Therefore, the difference of the diameters between the region 82A and the region 82B may become small. In such a condition, if the heat roller 81 is driven to rotate at the same speed as when the print operation has been interrupted, the surface speed of the backup roller 82 may not coincide with the desirable value because the thermal expansion condition of the backup roller 82 may have been changed with respect to the previous printing condition.

SUMMARY OF THE INVENTION

It is therefore an object of the present invention to provide an improved feeding device for an imaging apparatus using a continuous form sheet capable of responding to any feed speed change based on physical factors, and enabling the printer to constantly feed the recording sheet at a predetermined speed.

For the above object, according to the present invention, there is provided a feeding device for feeding a sheet-shaped member, comprising:

a pair of rollers being driven to feed the sheet-shaped member which is nipped between the pair of rollers;

driving means for driving one of the pair of rollers;

detecting means for detecting the feeding speed of the sheet-shaped member which may vary due to deformation of at least one of the rollers in its radial direction during feed operation; and controlling means for controlling the driving means in such a fashion that the rotational speed of one of the pair of rollers varies in order to maintain the feeding speed of the sheet-shaped member constant.

Optionally, the detecting means comprises means for measuring a period of time during which the sheet-shaped member has been fed by a predetermined amount so as to detect the feeding speed of the sheet-shaped member.

Further optionally, the feeding device is adaped to be employed in an electrophotographic imaging device for feeding the sheet-shaped member, the pair of rollers comprising a heat roller to be driven by the driving means and another roller to be inpressed contacted heat roller and driven by the heat roller, and the heat roller is driven by the driving means to rotate at a predetermined rotational speed when printing operation of the imaging device is started. Thereafter the rotational speed of the heat roller is changed by the controlling means.

Still further optionally, the feeding device further comprises determining means for determining the rotational speed of one of the pair of rollers when the printing operation is restarted after an interruption in accordance with the length of the interruption.

DESCRIPTION OF THE ACCOMPANYING DRAWINGS

DESCRIPTION OF THE EMBODIMENTS

Figure 2:
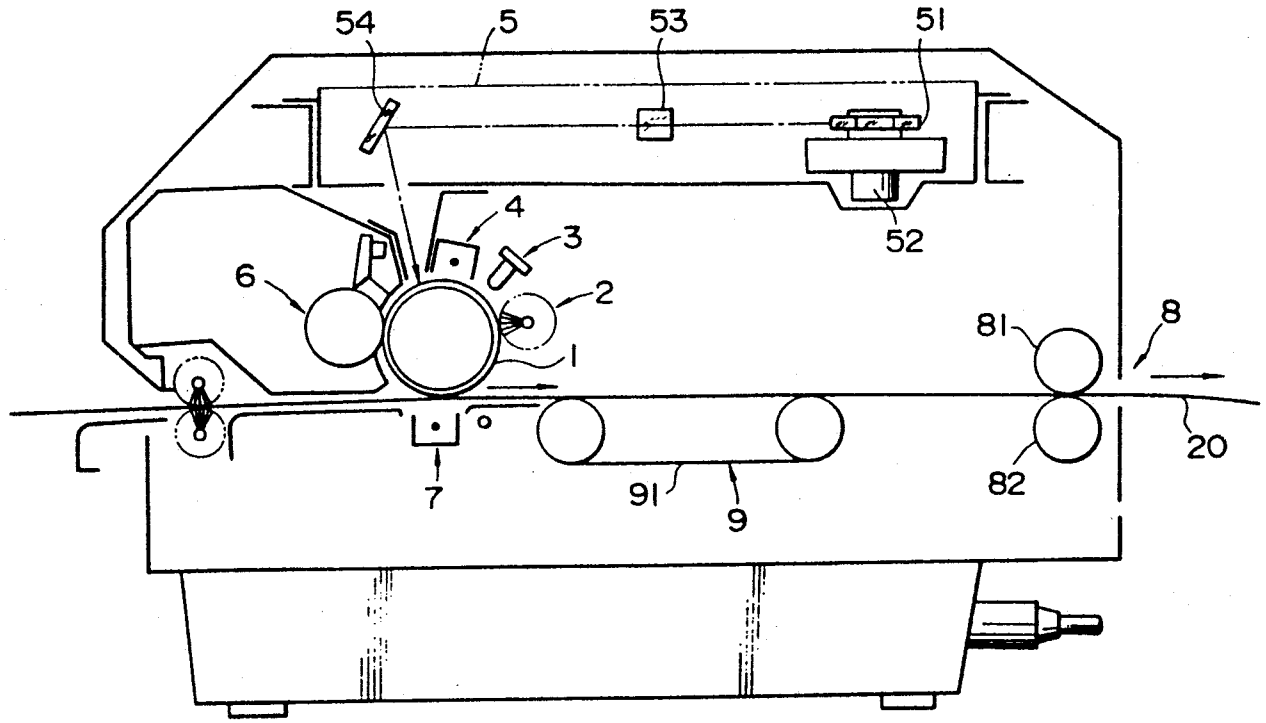
FIG. 2 is a schematic cross-sectional view showing a laser beam printer in accordance with one embodiment of the present invention.

FIG. 2 is a schematic cross-sectional view showing a laser beam in accordance with the present invention.

This laser beam printer outputs, in compliance with the electrophotographic image forming method, a hard copy of images or printing information inputted from a computer etc. by depicting them on a continuous paper 20 provided as a recording sheet. As the continuous recording sheet, also-called fan fold paper is used which has been conventionally used for line printers. The fan fold paper is provided with feeding holes at both side ends, and has perforated lines at the boundaries of respective pages, so that it can be cut or folded at the perforated lines.

A cylindrical photoconductive drum 1 is driven by a main motor (later shown) so as to rotate at a predetermined surface speed. Around the photoconductive drum 1, there are disposed, along a rotational direction of the photoconductive drum 1, a toner cleaning unit 2, a discharging unit 3, a charging unit 4, a scanning optical system 5, a developing unit 6, and a transferring unit 7. The scanning optical system 5 is constituted in such a manner that a laser beam ON/OFF modulated and emitted by a semiconductor laser (not shown) is deflected by a polygon mirror 51, which is driven by a polygon motor 52 to rotate at a predetermined rotational speed, and the thus deflected laser beam is corrected by an fΘ lens 53, and, in turn, guided on a circumferential surface of the photoconductive drum 1 by a reflection mirror 54 so as to form a scanning line (main scanning).

There is further defined a sheet feed path in a right-and-left direction in the drawing between the photoconductive drum 1 and a transfer portion 7. There is also provided a tractor unit 9 at the downstream side of the transfer portion 7 with respect to the sheet feed direction.

Figure 3:
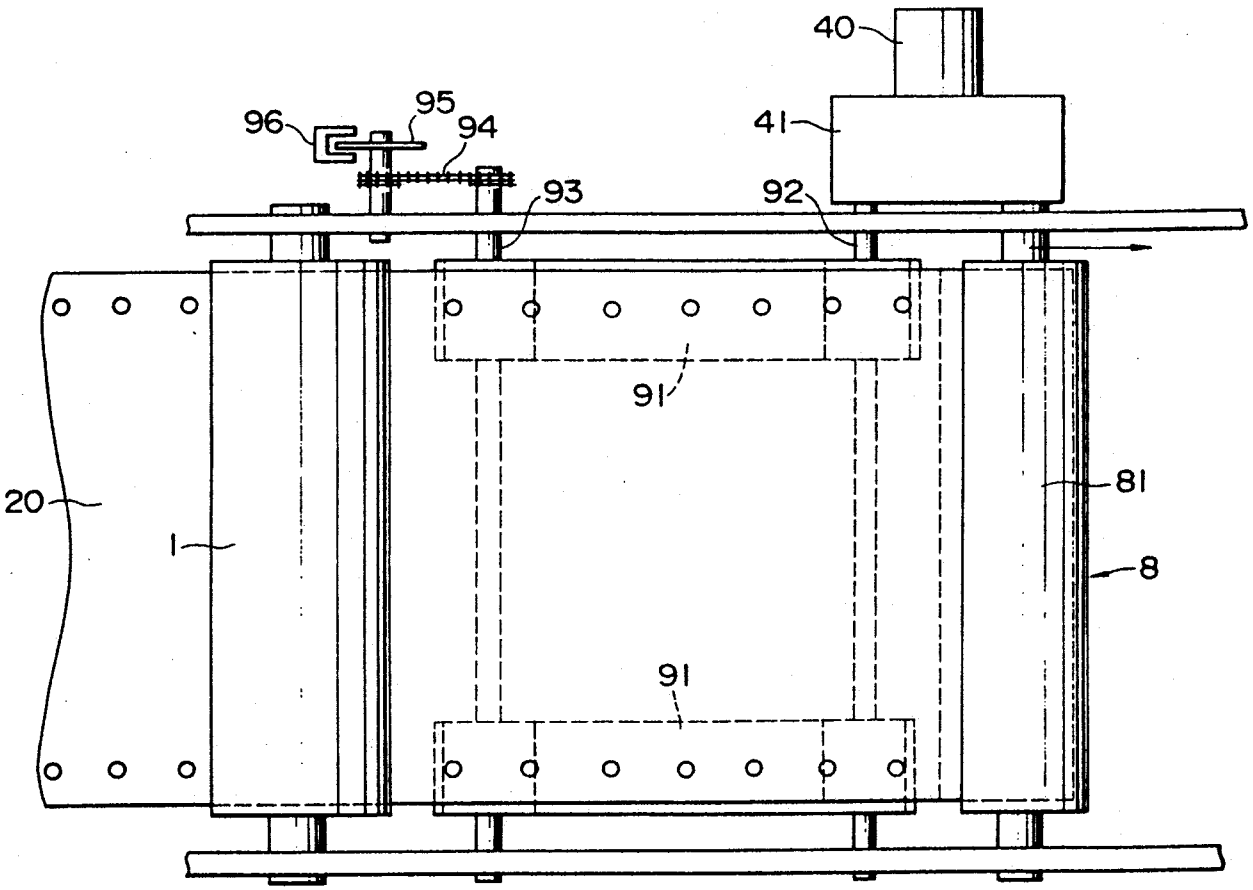
FIG. 3 is a plan view showing a recording sheet feeding portion of the laser beam printer in accordance with the one embodiment of the present invention.

The tractor unit 9 has a pair of endless belts 91 having a plurality of projections to be engaged with feed holes at both sides of the fan fold paper 20. These pair of endless belts 91 are wound between a drive shaft 92 and a driven shaft 93 in parallel with each other. The drive shaft 92 is connected with a main motor 40 via a field clutch and a gear train housed in a box 41 as shown in FIG. 3.

In this embodiment, a feeding operation of the fan fold paper 20 is basically carried out by a fixing unit 8. The endless belts 91 are driven in the same rotational direction as the sheet feed direction but slightly (approximately 1 through 2%) slower than the speed of the surface speed of the fixing unit 8.

That is, due to the difference of the rotational speed, the tractor 9 rotates with certain degree of resistance in accordance with the feeding operation of the fan fold paper 20 by the fixing unit 8. The resistance caused as above gives tension to the fan fold paper 20 between the tractor 9 and the fixing apparatus 8 so as to prevent a skew of the fan fold paper 20.

Figure 4:
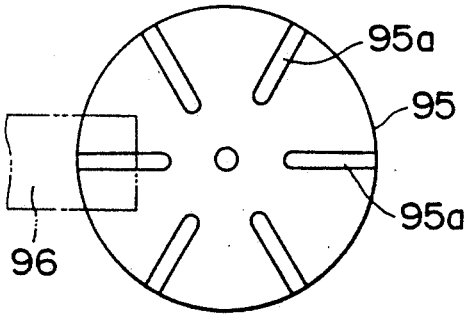
FIG. 4 is a view of an encoder generating PFS pulses.

The driven shaft 93 is connected via a chain 94 with a disk 95 provided as an encoder. The disk 95 is formed with a plurality of slits 95*a* at substantially the same intervals, as shown in FIG. 4. A photo sensor 96 is provided to detect this slits 95*a*. Accordingly, the photo sensor 96 outputs pulse signals in accordance with the rotation of the disk 95. Hereinafter, this photo sensor is referred to as a PFS (i.e. Paper feed sensor) and its output is referred to as a PFS pulse. A distance between feed holes of the fan fold paper 20 in the feeding direction thereof is ½ inch, and the disk 95 is designed to output the PFS pulse every time the fan fold paper 20 advances ½ inch.

The fixing unit 8 has a heat roller 81 accommodating a halogen lamp as a heating element so that the heat roller 81 can be heated to a predetermined temperature, and a back up roller 82 which is disposed to be in pressed contact with the heat roller 81. The heat roller 81 is connected through the clutch and the gear train housed in the box 41 to the main motor 40 so as to be rotated synchronously with the photoconductive drum 1 at substantially the same surface speed.

In the laser beam printer constituted in such a manner, the circumferential surface of the photoconductive drum 1 is main scanned (exposed) by the laser beam emitted from the scanning optical system 5 as aforementioned, and the photoconductive drum 1 is rotated (auxiliary scanned). The latent image formed on the circumferential surface of the photoconductive drum 1 is developed in the development portion 6 to form a toner image. The toner image is transferred onto the fan fold paper 20 fed by the fixing unit 8 in the transfer portion 7. Then, in the fixing unit 8, the toner image is fixed on the fan fold paper 20.

Figure 1:
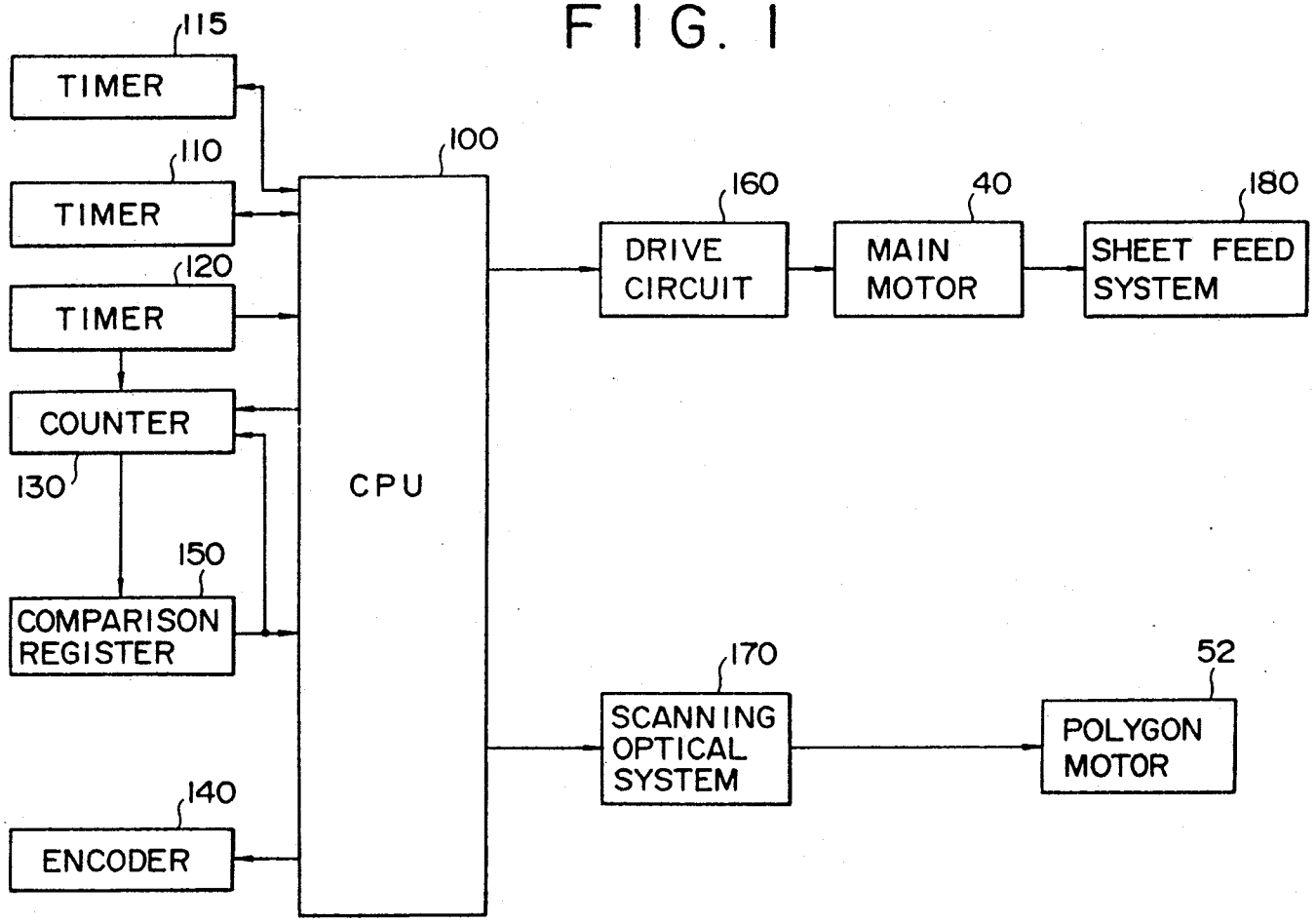
FIG. 1 is a block diagram showing a schematic constitution of a control unit in accordance with the present invention.

FIG. 1 is a block diagram showing a schematic constitution of a control unit in accordance with the present invention.

A central processing unit (i.e. CPU) 100 is associated with various devices. That is, a timer 110 measuring a period T of the PFS pulse, a timer 115 measuring a period TP during which the print operation is interrupted, a timer 120 measuring 1 μs for outputting a main motor driving pulse, a counter 130, a comparison register 150, and an encoder 140 outputting the PFS pulses in response to the feeding operation of the recording sheet 20 are connected to the CPU 100. And also, a drive circuit 160 driving the main motor 40 for driving a sheet feed system 180, and a scanning optical system control unit 170 controlling actuation of a polygon motor 52 of the scanning optical system 5 are connected to the CPU 100.

In this embodiment, the main motor (e.g. stepping motor) 40 is applied with an initial driving pulse of 1000 pulses/sec (hereinafter referred to as NO). When the initial driving pulse is applied, the main motor 40 rotates at a predetermined rotational speed, and with this condition, the recording sheet is fed at a standard speed of 50.8 mm (i.e. 2 inches) per second. Since it is designed that the PFS pulse is outputted every time the recording sheet 20 is fed ½ inch, a period of the PFS pulse becomes 250 ms.

Figure 5:
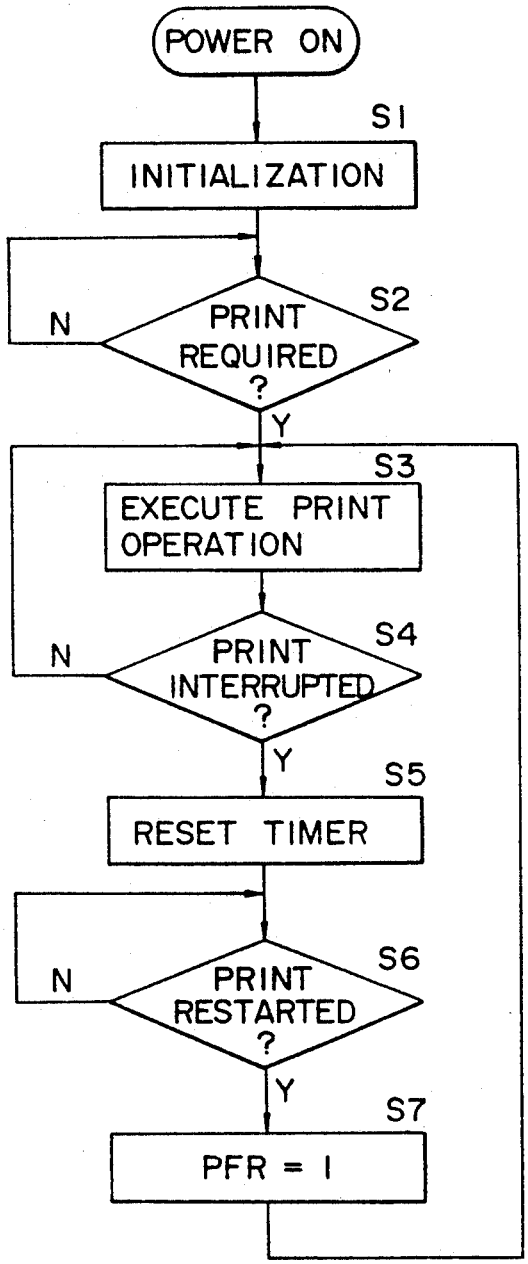
FIG. 5 is a flow chart illustrating an operation of the laser beam printer in accordance with the present invention.

FIG. 5 is a flow chart illustrating the operation of the laser beam printer in accordance with the present invention.

After a power source is turned on, an initialization of the CPU 100 is carried out in step S1. For example, a variable M for the PFS pulse counter is set to M=0. And also, mechanism check of the printer and warming-up, etc. are carried out in this step. A print restart flag PFR and driving pulse correction value n, which will be described later, are set to PFR=0, n=0, respectively.

Subsequently, in step S2, the CPU 100 waits until a print requirement is generated. If the print requirement is generated in step S2, the CPU 100 performs the printing operation at step S3.

Next, it is checked in step S4 whether or not the print operation is interrupted. If the judgement in step S4 is NO, the CPU 100 repeats the process of step S3. If the judgement in step S4 is YES, the timer 115 is reset to TP=0 in step S5. Then, it is checked in step S6 whether or not the print operation is interrupted. If the judgement in step S6 is NO, the CPU 100 repeats the process of step S6. If the judgement in step S6 turns to YES, the print restart flag PFR is set to PFR=1 in the next step S7 and returns to step S3.

Figure 6:
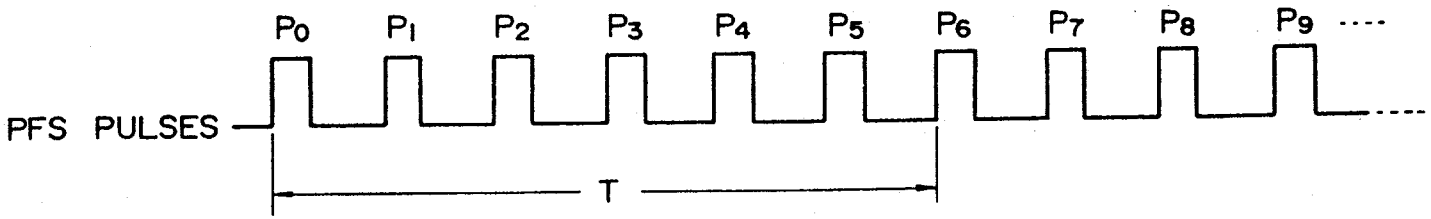
FIG. 6 is a graph showing the PFS pulses outputted from the encoder shown in FIG. 4.

When the print operation is carried out, the PFS generates the PFS pulses as shown in FIG. 6. Since the disk 95 has six slits and therefore six PFS pulses are generated during one complete revolution of the disk 95 in this embodiment, it becomes possible to control the paper feed speed at a constant speed by measuring a period T of succeeding six PFS pulses and comparing this measured period T with a reference time (250 ms×6=1500 ms) and, in turn, correcting the driving pulse number given to the main motor 40 by an amount corresponding to the difference detected by the above comparison.

The driving pulse to the main motor 40 is outputted as follows in the present embodiment.

The counter 130 counts the number of a time interval 1 μs which is measured by the timer 120. If the number of intervals counted by the counter 130 becomes equal to a value memorized in the comparison register 150, the driving pulse is outputted to the main motor 40.

For example, when the main motor 40 is driven at the standard speed N0 of 1000 pulses/sec, the comparison register 150 is set to 1000 at first. When a time interval of 1 μs is counted 1000 times, i.e., 1000 time intervals are counted, the value of the counter 130 coincides with the memorized value of comparison register 150. Thus, the reference value of the driving pulse number N can be adjusted to N0=1000 pulses/sec. This shows that a resolution of the main motor 40 with respect to the interval of the PFS pulse is 0.1%. Accordingly, a resolution of the timer in measuring the interval of the PFS pulses should be less than 1500 ms×0.1% =1.5 ms.

Though the period of one complete revolution of the disk 95 is measured in this embodiment, it is possible to obtain the sheet feed speed by measuring an interval of two continuous PFS pulses. However, it is practically difficult to set accurately a period of each pulse because of error in forming each slit or offset of the disk 95. Therefore, a measuring method of the present embodiment measuring a period of one complete revolution can suppress such an influence derived from these kinds of errors to an extremely small degree.

Figure 7:
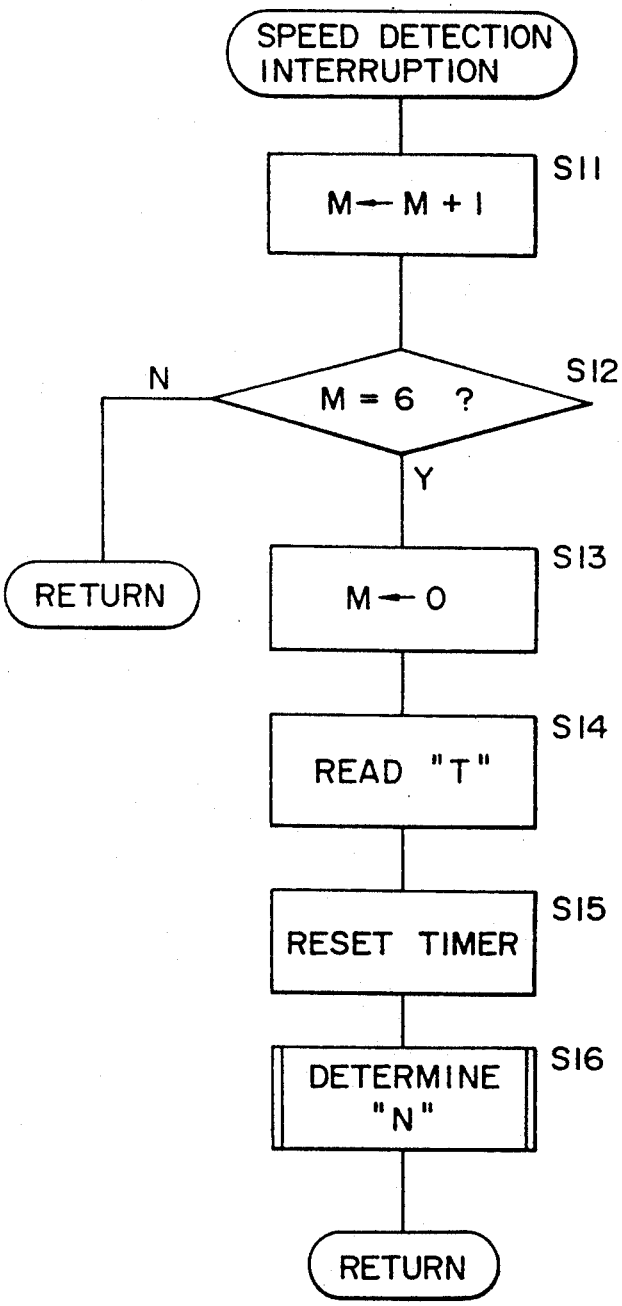
FIG. 7 is a flow chart illustrating a speed detection interruption routine for a sheet feed operation.

FIG. 7 is a flow chart illustrating a speed detection interruption routine for a recording sheet feed operation.

This interruption routine is carried out in response to a rise-up of each pulse shown in FIG. 6. In step S11, pulse number is counted by incrementing the variable M. Then, in step S12, it is checked whether the value of M is equal to 6. If the variable M is less than 6, only the counting process is executed, the interruption routine is terminated, and the process returns to the main routine shown in FIG. 5. If the variable M equals 6, i.e., the disk 95 has made one complete revolution, the variable M is reset to 0 in step S13. Then, the period T is obtained by the timer 110 in step S14 and the timer 110 is reset to 0 in step S15 for next measuring operation. Subsequently, a driving pulse number N to be outputted to the main motor 40 is calculated on the basis of the detected period T in step S16.

Figure 8:
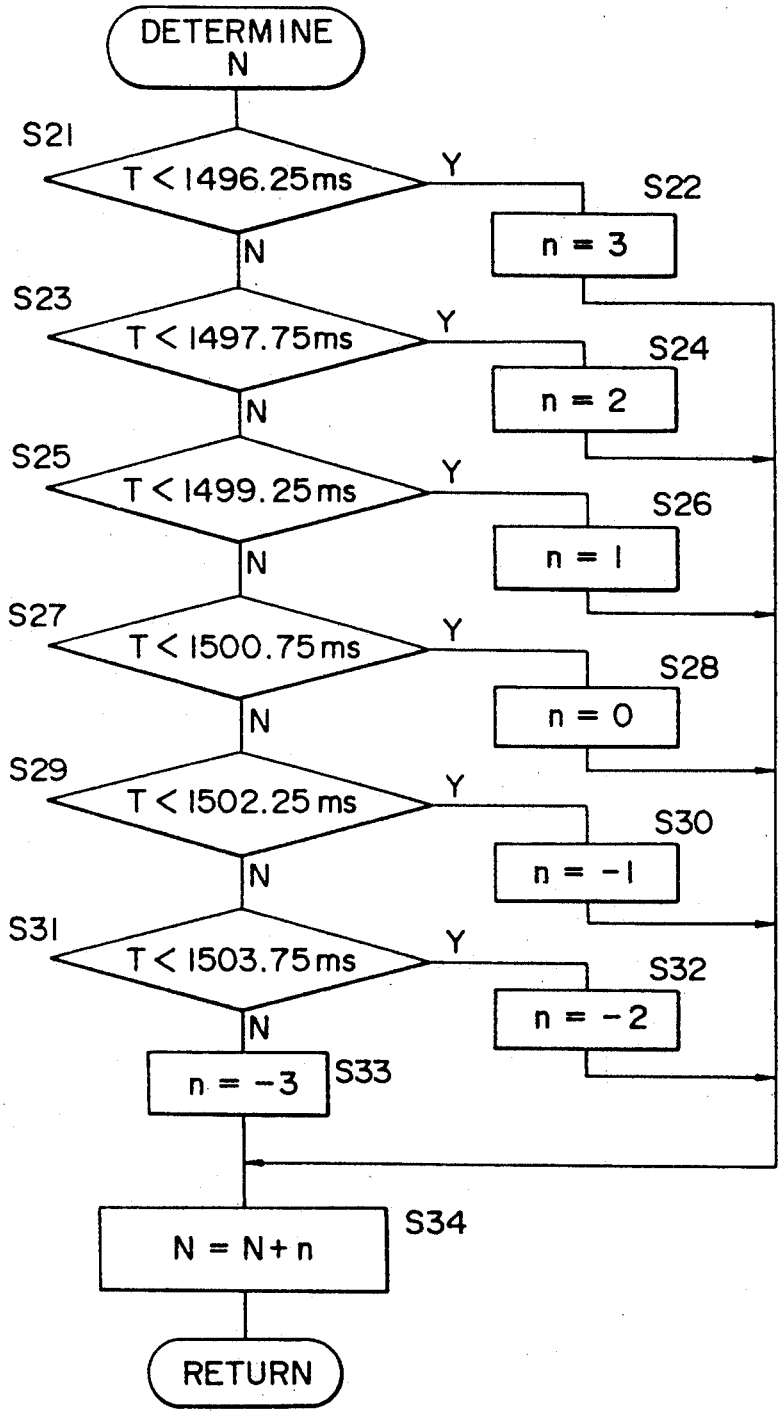
FIG. 8 is a flow chart illustrating a correction value setting for the main motor driving pulse.

FIG. 8 is a subroutine for obtaining the driving pulse number N to be outputted to the main motor 40 on the basis of the detected period T. In steps S21 to S33, based on the period T for one complete rotation of the disk 95, i.e., the period in which the recording sheet is fed by 3 inches, the compensation value n is determined. Then the driving pulse number N to be outputted to the main motor 40 is compensated in step S34 in accordance with the following equation (1).

$$N=N+n \quad (1)$$

Then, the process returns to the main routine shown in FIG. 5.

Figure 9:
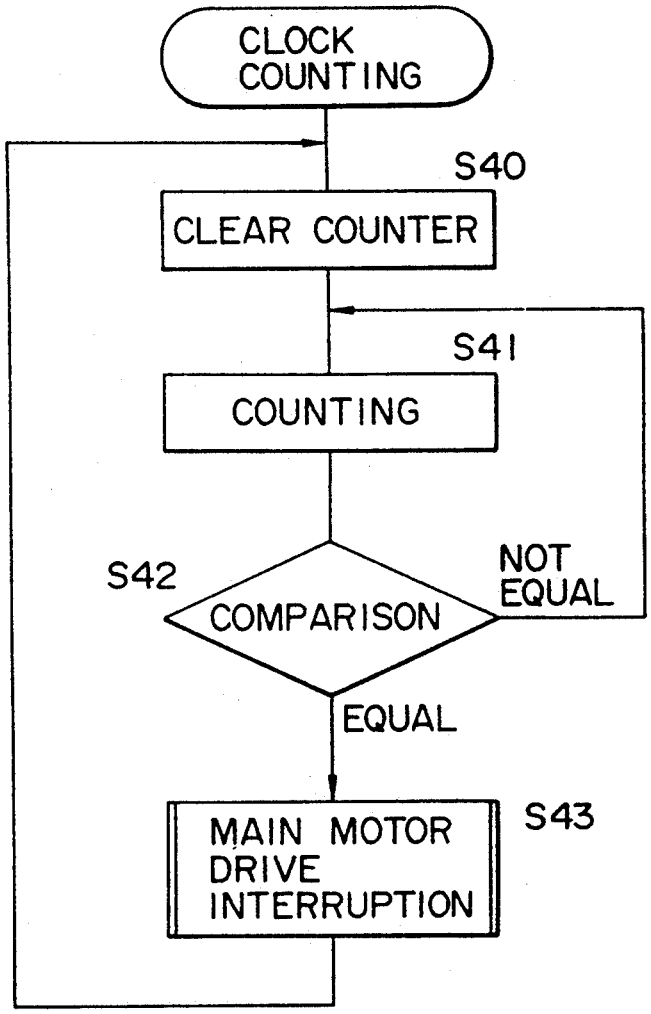
FIG. 9 is a flow chart illustrating a clock count procedure for generating the main motor driving pulse.
Figure 10:
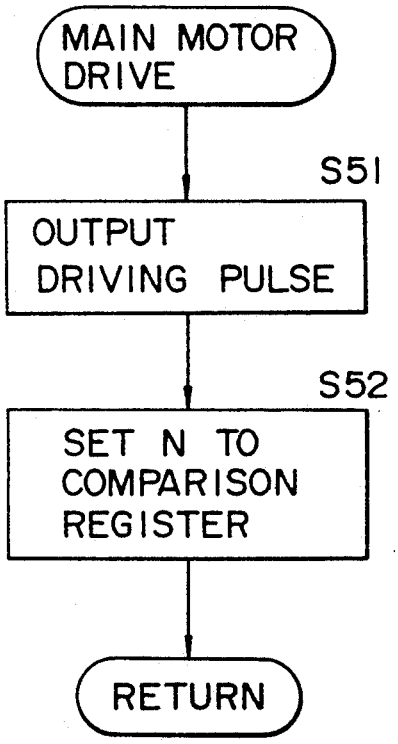
FIG. 10 is a flow chart for executing the interruption routine for driving the main motor.

FIGS. 9 and 10 are flow charts illustrating the procedure for actuating the main motor 40 on the basis of the pulse number N.

In FIG. 9, the counter 130 is cleared in step S40. Then, the counter executes the count-up at intervals of 1 μs in step S41. Then, it is checked in step S42 whether or not a count value of the counter 130 equals the pulse number N set in the comparison register 150. If the judgement in the step S42 is NO, the process returns to the step S41 to increment the count value of the counter 130.

If the judgement of the step S42 is YES, i.e., if the count value become equal to the pulse number N, the process advances to step S43 to require an execution of the interruption routine for driving the main motor.

It should be noted that the procedure illustrated in FIG. 9 is automatically performed bu a circuit (not shown) without being managed by the CPU 100.

FIG. 10 is a flow chart illustrating the interruption routine for driving the main motor. In step S51, the driving pulse is outputted to the main motor 40. Then, the driving pulse number N obtained in accordance with the procedure shown in FIG. 8 is set in the comparison register 150. Note that the initial value of the driving pulse number N is set to 1000.

Though the correction value is obtained from six PFS pulses in this embodiment; i.e. the period T is obtained based on P0 to P5 at first time and the next period T is obtained based on P6 to P11, other methods can also be used. For example, it becomes possible to finely control the paper feed speed if the period T is successively obtained based on P0 to P5, P1 to P6, P2 to P7, and so on.

Accordingly, in accordance with the speed control of this embodiment, even if physical conditions affecting the feeding speed such as thermal expansion of the feeding rollers or expansion/contraction of the recording sheet are varied, the feeding speed can be adequately maintained at a desirable speed.

Next, a feed speed control in the case the printer interrupts its print operation is explained.

Figure 11:
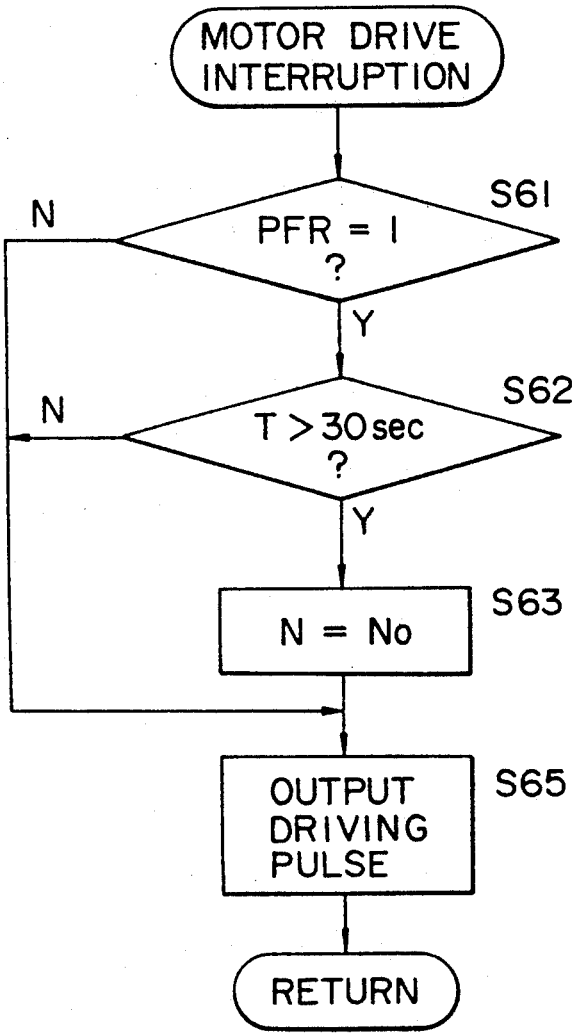
FIG. 11 is a flow chart illustrating a motor drive interruption routine.

FIG. 11 is a flow chart showing a motor drive interruption routine. This interruption routine is carried out at predetermined intervals while printing operation is executed.

In step S61, it is checked whether or not the print resume flag PFR is 1. If the judgement in step S61 is YES, it is further checked in step S62 whether or not the time TP during which the print operation is interrupted is longer than 30 seconds. If the judgement in step S62 is YES, the driving pulse value N is set to NO in step S63. That is, if the print operation is paused for a long time (i.e. more than 30 seconds, in this embodiment), the driving pulse N is reset to the initial value NO. This is because the thermally expanded condition of the fixing rollers is substantially removed within a relatively long period of time. In other words, the compensated value N may cause malfunction after a long time interruption of the printing operation. Accordingly, the driving pulse number N is set to the initial value NO.

On the other hand, if the judgement in the step S62 is NO, the driving pulse number N is used as it is. This is because the thermal expansion condition of the fixing rollers is substantially the same as the condition when the printing operation was interrupted. Similarly, if the judgement in step S61 is NO, the driving pulse number N is not changed.

Subsequently, the driving signal based on the obtained driving pulse number N is outputted in step S65.

Figure 12:
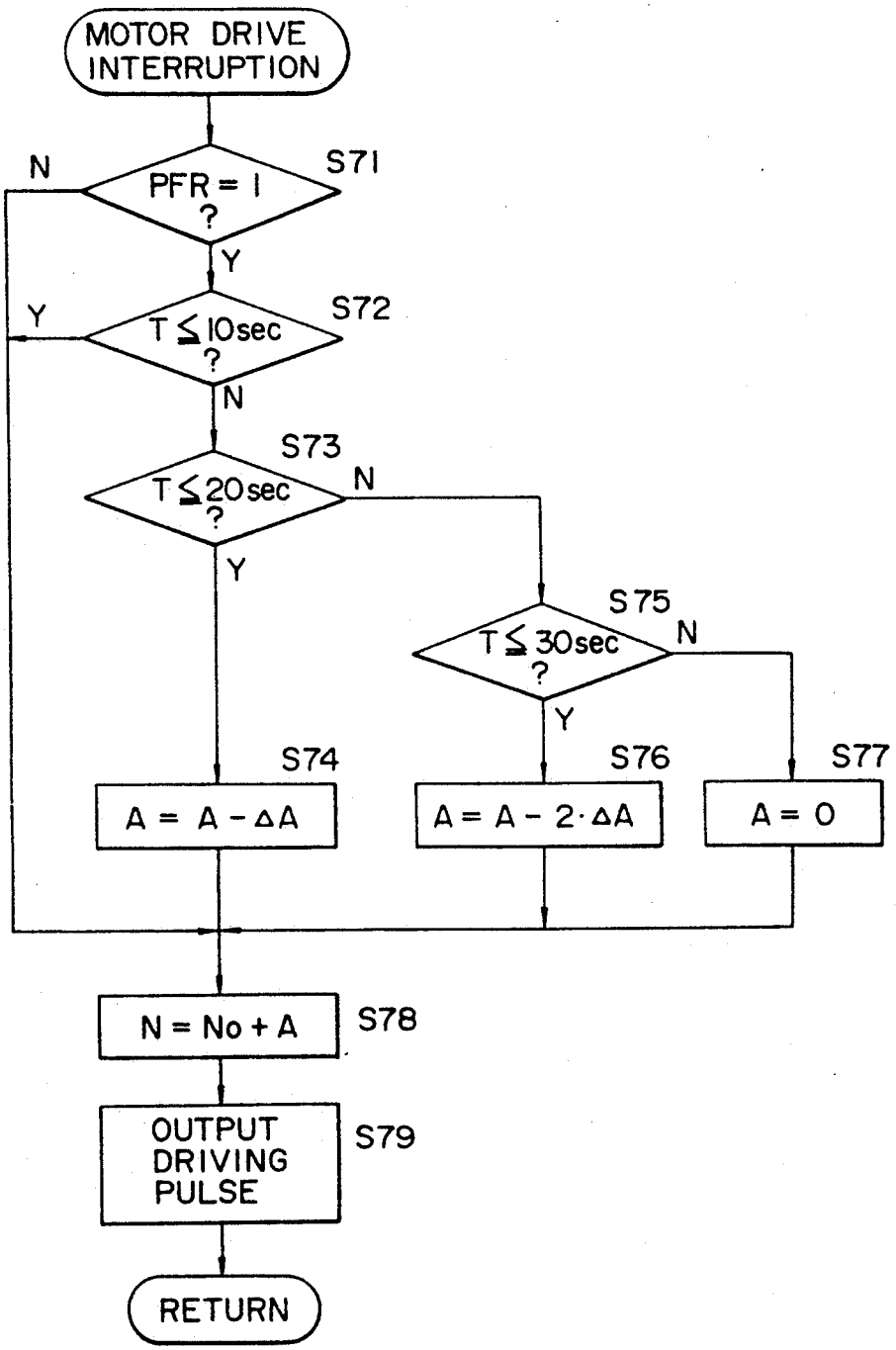
FIG. 12 is a flow chart illustrating another example of the motor drive interruption routine.
Figure 13:
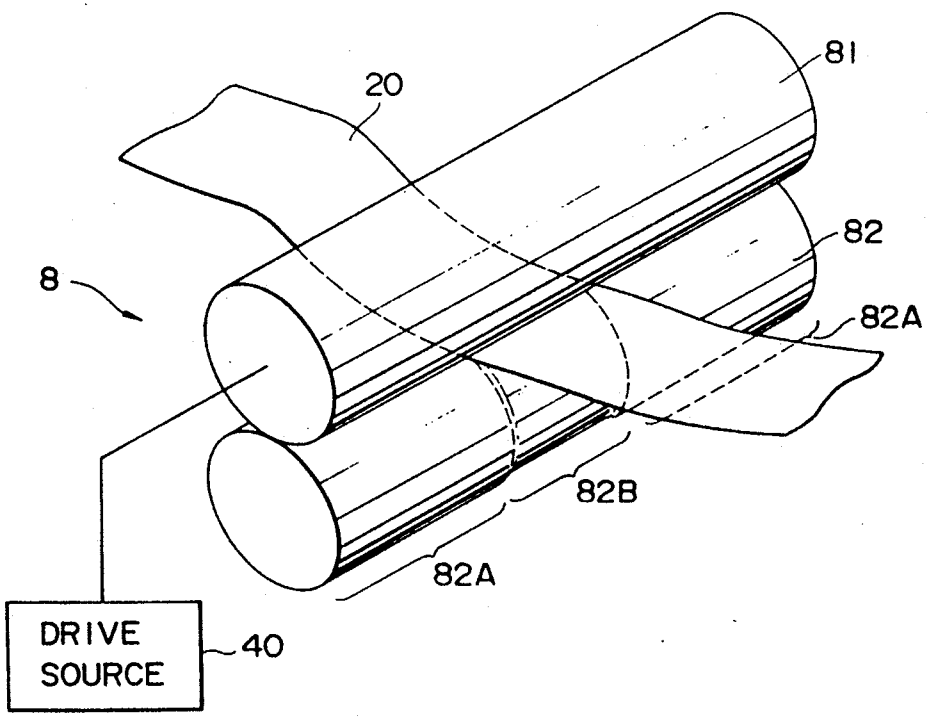
FIG. 13 is a schematic perspective view showing a pair of fixing rollers functioning as sheet feed means.

FIG. 12 is a flow chart showing another example of the resume correction interruption routine. This example is different from the one shown in FIG. 11 in that one of four additional procedures are selectively taken in accordance with the value of the elapsed time TP.

In the embodiment shown in FIG. 12, a compensation parameter A is introduced. The compensation parameter A is defined as:

$$A=N-NO,$$

wherein, N is the driving pulse number at the time when the printing operation is interrupted.

In step S71, it is checked whether or not the print resume flag PFR is 1. If the judgement in the step S71 is YES, it is further checked in step S72 whether or not the time TP is not greater than 10 seconds. If the judgement in step S72 is YES, the driving pulse number N is calculated with the following formula:

$$N=NO+A$$

which is indicated at step S78 in FIG. 12. In the case described above, the compensation parameter A is not changed during the interruption. Thus, the driving pulse number N is set to the same value as it was at the time when the printing operation was interrupted.

If the judgement in step S72 is NO, it is further checked in step S73 whether or not the time TP is not greater than 20 seconds. If the judgement in step S73 is YES, the correction value A is modified as (2).

$$A=A-\Delta A \quad (2)$$

Then, in step S78, the driving pulse number N is updated in step S74 by using the modified compensation parameter A.

If the judgement in step S73 is NO, it is further checked in step S75 whether or not the time TP is not greater than 30 seconds. If the judgement in step S75 is YES, the compensation parameter A is modified as (3).

$$A=A-2.\Delta A \quad (3)$$

Then, the driving pulse number N is updated in step S76 by using the modified compensation parameter A.

If the judgement in step S75 is NO, in step S77, the compensation parameter A is set to 0. Thus, the driving pulse number N is set to NO in this case.

Subsequently, in step S79, the driving signal based upon the driving pulse number N obtained as above is outputted. That is, if the print operation is stopped for a short period of time; for example, less than 10 seconds, it is considered that the thermal expansion condition of the fixing rollers is not substantially changed. Therefore, the compensation parameter A is used without modifying its value by taking the interruption of the printing operation into consideration.

If the time TP is 10 seconds or more, it is considered that the compensation parameter A needs to be modified by a certain degree in accordance with the length of the time TP.

In this embodiment shown in FIG. 12, the compensation parameter A is set to 0 when the time TP exceeds 30 seconds. And, ΔA in the above equations (2) and (3) is determined as A/3. In other words, if there are K compensation steps within the time TP, the value of ΔA can be generally expressed as follows.

$$\Delta A=A/(K-1) \quad (4)$$

Therefore, the larger the value of K becomes, the more accurately the compensation parameter A can be modified.

It is also possible to store a plurality of correction data in accordance with the time TP in a memory device of the CPU 100 in advance, so that the rotational speed of the heat roller 81 can be controlled by reading out the stored data.

Accordingly, in accordance with the feeding device embodying the present invention, even if the printing operation is interrupted during a certain period of time, the printing operation can be smoothly restarted without causing any troubles derived from affection of interruption of the printer.

As this invention may be embodied in several forms without departing from the spirit of essential characteristics thereof, the present embodiments are therefore illustrative and not restrictive, since the scope of the invention is defined by the appending claims rather than by the description preceding them, and all changes that fall within meets and bounds of the claims, or equivalence of such meets and bounds are therefore intended to embraced by the claims. The present disclosure relates to subject matters contained in Japanese Patent Applications Nos. HEI 3-245297, filed on Jun. 19, 1991, and HEI 3-264253, filed on Jul. 9, 1991, which are expressly incorporated herein by reference in their entireties.

What is claimed is:

1. A feeding device for feeding a sheet-shaped member, comprising:

a pair of rollers being driven to feed said sheet-shaped member which is nipped between said pair of rollers;

driving means for driving one of said pair of rollers;

detecting means for detecting the feeding speed of said sheet-shaped member, wherein the feeding speed may vary due to deformation of at least one of said rollers in its radial direction during feed operation; and controlling means for controlling said driving means in such a fashion that the rotational speed of said at least one of said pair of rollers varies in order to maintain the feeding speed of said sheet-shaped member constant.

2. The feeding device according to claim 1, wherein said detecting means comprises means for measuring a period of time during which said sheet-shaped member has been fed by a predetermined amount so as to detect the feeding speed of said sheet-shaped member.

3. The feeding device according to claim 1, wherein said feeding device is for use in an electrophotographic imaging device for feeding said sheet-shaped member, wherein said pair of rollers comprise a heat roller to be driven by said driving means and another roller to be in pressed contact with said heat roller and driven by said heat roller, and wherein said heat roller is driven by said driving means to rotate at a predetermined rotational speed when printing operation of said imaging device is started, thereafter the rotational speed of said heat roller is changed by said controlling means.

4. The feeding device according to claim 3, which further comprises determining means for determining the rotational speed of said at least one of said pair of rollers when the printing operation is restarted after an interruption in accordance with the length of said interruption.

5. The feeding device according to claim 4, wherein said determining means determines the rotational speed of said heat roller based upon the rotational speed of said heat roller at the time when the printing operation was interrupted.

6. The feeding device according to claim 4, wherein said determining means determines the rotational speed of said heat roller to be the same as the rotational speed of said heat roller at the time when the printing operation was interrupted in case the interruption continued more than a predetermined time.

7. The feeding device according to claim 3, wherein said sheet-shaped member comprises a continuous form recording sheet.

* * * * *